US005362044A

United States Patent [19]

Hageman

[11] Patent Number: 5,362,044

[45] Date of Patent: Nov. 8, 1994

[54] MODIFIED GOLF CUP

[76] Inventor: Kent D. Hageman, 204 Brookside Blvd., Hinckley, Ohio 44233

[21] Appl. No.: 39,930

[22] Filed: Mar. 29, 1993

[51] Int. Cl.[5] ..... A63B 57/00

[52] U.S. Cl. ..... 273/34 R

[58] Field of Search ..... 273/34 R, 34 A, 34 B, 273/178 R, 178 A, 178 B; 40/306

[56] References Cited

U.S. PATENT DOCUMENTS

| | | | |
|---|---|---|---|
| 1,660,580 | 2/1928 | Schaum | 273/34 R |
| 1,813,696 | 7/1931 | Crocker . | |
| 1,840,038 | 1/1932 | Jones et al. | 273/34 R |
| 3,511,501 | 5/1970 | Sandberg | 273/34 |
| 3,643,944 | 2/1972 | Boyes | 273/34 R |
| 4,878,665 | 11/1989 | Boudreau et al. | 273/34 R |
| 4,900,023 | 2/1990 | Gelina | 273/34 B |
| 4,928,417 | 5/1990 | Boudreau | 40/642 |
| 5,029,856 | 7/1991 | Bookspan | 273/34 R |
| 5,078,394 | 1/1992 | Kretz | 273/34 B |
| 5,180,162 | 1/1993 | Browne | 273/34 R |

*Primary Examiner*—Mark S. Graham
*Attorney, Agent, or Firm*—David Yates; Thomas M. Champagne; Jon L. Roberts

[57] ABSTRACT

An improved golf cup and in particular to a golf cup which has all the features of a normal golf cup and conforms with the appropriate Professional Golfer's Association (PGA) rules and regulations but, additionally, has been modified to provide a means to contain an advertisement. The advertisement can be inserted and removed at will, without disturbing the normal functioning of the cup. The advertisement is in the form of a flexible insert that can be snapped into an indentation in the inner wall of the golf cup. A small hole is placed within the recessed area to facilitate the insertion of a screwdriver or like device to assist in the removal of the advertising insert which has been snapped into place. The advertising insert is constructed of a light, flexible durable material which is flat when not inserted into the golf cup and is, therefore, easy to handle, store and ship.

17 Claims, 2 Drawing Sheets

MODIFIED GOLF CUP

FIELD OF THE INVENTION

The present invention relates generally to an improved golf cup and in particular to a golf cup which has all the features of a normal golf cup and conforms with the appropriate Professional Golfer's Association (PGA) rules and regulations but, additionally, has been modified to provide a means to contain an advertisement, which can be inserted and removed at will, without disturbing the normal functioning of the cup.

Background of the Invention

In the past, golf cups have been primarily used to hold golf balls, which pass into them at the completion of a successful putt or stroke, and to support the flag which marks the hole. These cups are inserted into a round cylindrical opening in the green and are recessed below the level of the green according to PGA regulations and contain holes in the bottom of the cup to facilitate drainage of water. Prior modifications to golf cups have generally served the purposes of diminishing the size of the available opening to serve as a training aid for putting. Other modifications have improved the ability of the cup to support and hold the flag without tilting.

The significant interest shown by the general public in the game of golf and the large numbers of golfers currently playing the game suggest the desirability of linking advertising means to the game and to the accoutrements of golf.

One attempt to provide this linkage is described in U.S. Pat. No. 4,928,417 to Boudreau which disclosed a doughnut-shaped insert that contains an advertisement which will fit or snap into any conventional golf cup. This invention does not modify the golf cup but attaches the doughnut-shaped insert by means of prongs into the existing drainage holes of the conventional golf cup or places the insert (without prongs) directly onto the portion of the cup which contains the drainage holes and forces the drainage water to pass through the slight opening at the perimeter of the insert. This invention relies on the placement of a rigid insert into a conventional golf cup and sacrifices the drainage openings to provide a means to hold or support the insert.

U.S. Pat. No. 4,878,665 to Boudreau et al. discloses a golf cup modified to provide a twist-on connection means for attaching an insert disc at the bottom thereof. The advertising is intended to be displayed on the insert in much the same manner as the invention discussed above. This invention modifies the golf cup to provide a means for attaching the insert disc in a more secure manner. It still results in the blockage of the drainage openings because of the disc placement location and relies on the placement of a rigid insert into the cup.

U.S. Pat. No. 3,511,501 to Sandberg discloses a golf cup adapted to be concealed when not in use. An inner receptacle, sized to snugly fit within the golf cup, is filled with growing lawn grass so that the golf cup is substantially concealed when the inner receptacle is inserted into the cup. This invention does not relate to the objective of providing means to capitalize on the golf cup for advertising purposes and could not be reasonably adapted to do so.

U.S. Pat. No. 4,900,023 to Gelina provides a golf cup insert which can be easily frictionally engaged to provide for variation of the effective size of the golf cup. This invention is an aid for increasing a golfer's skill in putting by varying the size of the receptacle to sizes smaller than normal thereby increasing the putting accuracy which must be developed. This invention does not relate to the objective of providing an advertising means and cannot be reasonably adapted to do so.

U.S. Pat. No. 5,078,394 to Kretz also discloses a putting skill improvement device having a simulated putting green grass surface and a special lip design to insure the cup opening is level with the putting surface. This invention provides no means for advertising and cannot be reasonably adapted to do so.

U.S. Pat. No. 1,813,696 to Crocker discloses the placement of a cylindrically formed sheet of fibrous material as a lining for the top portion of the hole made in the green to accommodate a conventional golf cup to provide stability to the top portion of the hole and to prevent crumbling of the hole. This invention relates only to the structural integrity of the hole in which the golf cup is placed and provides no means for advertising.

Of the six inventions described above, four relate totally to purposes other than providing a means to capitalize on the popularity of golf and the large number of golfers currently playing the game as an advertising opportunity. Two of these four inventions relate to a means of improving putting skills, one relates to a method of concealing a golf cup, and the final one relates to a means of providing structural stability to the top of the earthen hole containing the golf cup. The two inventions which relate to advertising means do so through the insertion of a rigid disc, secured by various means, which has displayed thereon the advertising message. These rigid inserts are difficult to ship and handle, are subject during use to constant impact by the golf ball in a manner likely to lessen their durability and effectiveness, and cover to a great extent the drain holes needed to provide a means for ground water to drain from the hole. In addition, these advertising inserts are subject to frequent impact by the flag pin inserted into the cup between putts. The impact and rubbing of the pin not only damages the insert, but causes wear to and accumulation of dirt on the insert. A dirty and worn advertisement is likely to have a negative impact on a consumer, a result that is exactly the opposite of the intended effect. None of the referenced inventions provides the advantages, ease of use, durability, or minimal impact to the primary purpose of the golf cup as does the present invention.

SUMMARY OF THE INVENTION

The invention relates to a golf cup which has all the features of a normal golf cup and conforms with the appropriate Professional Golfer's Association (PGA) rules and regulations. This cup has been modified, however, by the creation of a recessed portion (indentation) in the circular cylindrical wall of the cup wherein a changeable advertisement can be inserted and replaced at will. The advertisement is in the form of a flexible insert that can be snapped into place. A small hole is placed near the top of the golf cup and within the recessed area to facilitate the insertion of a screwdriver or like device to assist in the removal of the advertising insert which has been snapped into place. The advertising insert is constructed of a light, flexible durable material which is flat when not inserted into the golf cup and is, therefore, easy to handle, store and ship. The placement of the insert within the cup and the slight edge provided by the lip defining the upper edge of the recessed portion of the cup is such that impacts by an entering golf ball are infrequent and glancing and the durability of the insert is therefore greatly increased. The placement of the insert in the recessed portion or indentation of the golf cup is well above the drain holes provided in the bottom of the cup. Thus, the insert does not impede the drainage of ground water in any way.

BRIEF DESCRIPTION OF THE DRAWINGS

The following figures illustrate the nature of the modifications to the golf cup and the flexible inserts which contain the advertising message.

DETAILED DESCRIPTION OF THE PREFERRED EMBODIMENTS

Figure 1:
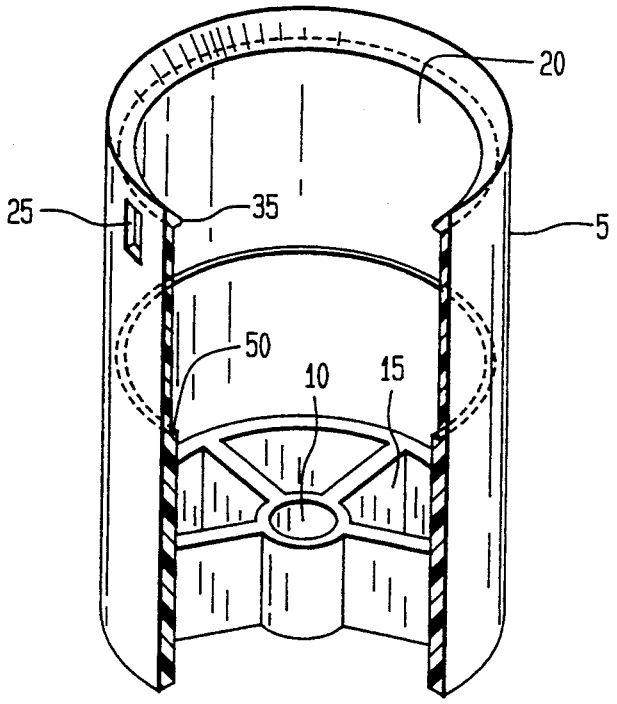
FIG. 1 shows a cut-away view of a standard golf cup with modifications for acceptance of the flexible insert.

Referring to FIG. 1, a conventional golf cup 5 is depicted which conforms to all appropriate PGA rules and regulations both before and after the modifications called for in this invention. Neither the opening for insertion of the flag 10 nor the drain holes 15 for the removal of ground water are affected or hampered in any way by this invention. A recessed area or indentation 20 has been formed in the circularly cylindrical inner wall of the golf cup well above the drain holes 35 and slightly below the top of the cup. This indentation 20 is approximately 3 inches in height in the preferred embodiment and extends over the entire circumference of the interior or inner wall of the cup but can be any height which is less than the distance between the bottom surface and top edge of the golf cup and which corresponds to the height of a flexible insert on which advertising or a message is printed. The height of the indentation 20 can be varied to achieve a balance between the available area on which to display the advertising message versus the ease of use and minimization of the impact frequency of golf balls as they enter the golf cup.

A lip 35 may be formed at the top of the indentation 20. This lip 35 is angled downward in order to retain the insert that is placed in the indentation. The lip 35 also functions to deflect a ball which is being putted into the golf cup from impacting upon the insert.

An annular shoulder 50 may be formed at the bottom of the indentation 20. When inserted, the bottom of the flexible insert rests on the shoulder to provide support for the insert. In an alternative embodiment, the insert rests directly on the bottom surface of the golf cup, flush with the inner wall of the golf cup so that the insert does not block the drain holes in the bottom surface of the golf cup.

A small opening 25 is placed somewhere along the indentation 20, preferably near the top of the indentation, to facilitate the insertion of a tapered tool such as a screwdriver or any like device to facilitate removal of the flexible insert when desire. In an alternative embodiment, the indentation 20 extends over less than the entire circumference of the inner wall of the cup, and the opening 25 is located at the right and/or left edge of the indentation 20, perhaps spanning the interface between the indentation 20 and the non-indented portion of the inner wall of the cup.

Figure 2:
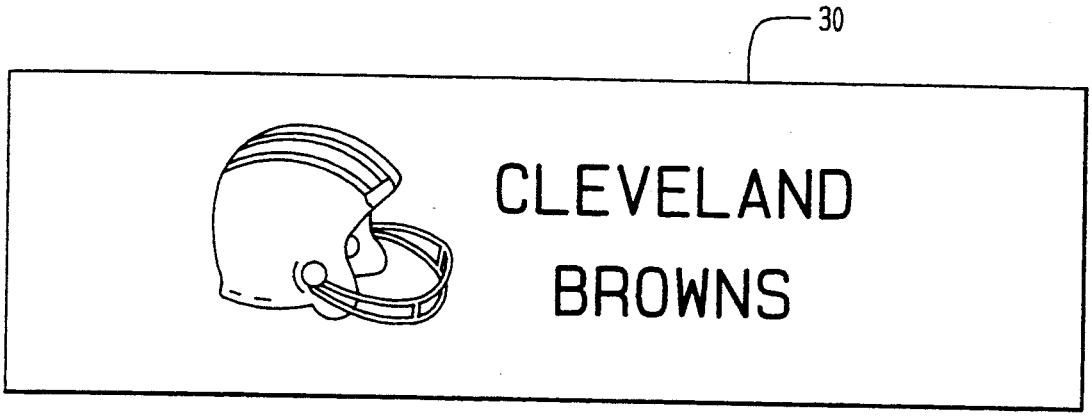
FIG. 2 shows the flexible insert in its flat orientation.

FIG. 2 depicts the flexible insert 30 on which the advertising message has been placed, in its flat or unflexed orientation. This orientation provides for maximum ease of printing or painting of the advertising message, minimum requirements of storage space for the replacement inserts, and maximum ease of shipping.

Figure 3:
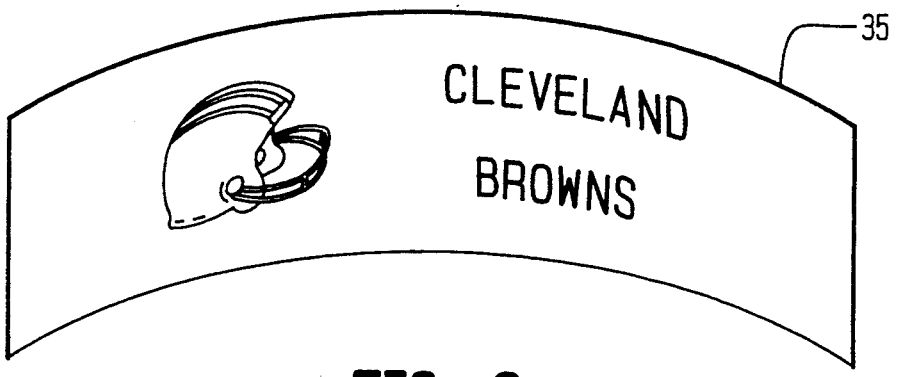
FIG. 3 shows the flexible insert in the beginning stages of being flexed for insertion into the modified golf cup.

FIG. 3 shows the insert 40 on which the advertising message has been placed in a partially flexed state. This partially flexed state represents the initial stages of flexing the insert in preparation for placement into the indentation. The insert 40 may be constructed from any flexible, durable material that can be formed in a thin sheet. Plastic is an example of a suitable material from which the insert may be constructed.

Figure 4:
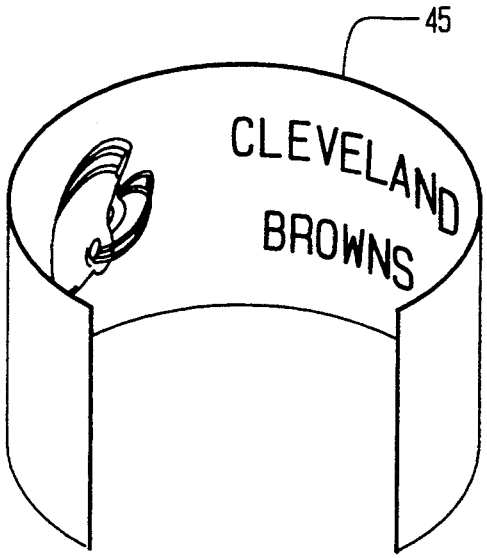
FIG. 4 shows the flexible insert being flexed and ready for insertion into the modified golf cup.

Referring to FIG. 4, the flexible insert 45 with the advertising message already displayed upon it is shown in its flexed state ready to be inserted into the indentation 20 in the cup. The length of the flexible insert 45 can be any length less than the circumference of the golf cup which corresponds to the length of the indentation 20 which has been placed therein. Typically, the flexible insert will be approximately 13¼ inches in length.

While the invention has been particularly shown and described in reference to the preferred embodiments thereof, it will be understood by those skilled in the art that changes in form and details may be made without departing from the spirit and scope of the invention.

I claim:

1. A golf cup modified for advertising comprising:

a) a golf cup having a top edge and a bottom surface spanned by a circularly cylindrical inner wall, the inner wall having a circumference and an indentation and the bottom surface of the golf cup having drain holes, the indentation having a top and a bottom;

b) at least one flat flexible insert having a length and a height, on which advertising material is printed, which when flexed can be removably attached to the golf cup such that the insert is flush with the inner wall and entirely within the indentation; and c) a downwardly angled lip around the circumference of the inner wall near the top edge of the golf cup, the lip defining the top of the indentation.

2. The modified golf cup according to claim 1, wherein the lip further functions as a means for removably attaching the flexible insert to the golf cup.

3. The modified golf cup according to claim 2, wherein the golf cup further comprises an annular shoulder around the circumference of the inner wall near the bottom surface of the golf cup, the shoulder defining the bottom of the indentation and functioning as a support for the flexible insert.

4. The modified golf cup according to claim 1, wherein the inner wall further has an opening for accommodating the tip of a tapered tool to facilitate removal of the flexible insert from the golf cup.

5. The modified golf cup according to claim 3 wherein the length of the flexible insert is no longer than the circumference of the inner wall and the height of the flexible insert corresponds to a distance between the downward facing lip and the annular shoulder.

6. The modified golf cup according to claim 2 wherein the length of the flexible insert is no longer than the circumference of the inner wall and the height of the flexible insert corresponds to a distance between the downward facing lip and the bottom surface of the golf cup.

7. The modified golf cup according to claim 5 wherein the flexible insert measures approximately 3" in height and 13¼" in length.

8. A method of advertising on a golf course comprising the steps of:

a) modifying a golf cup having a top edge, a bottom surface, and an inner wall such that the inner wall has a circumferential indentation having a top and a bottom;

b) removably attaching a flexible insert on which advertising can be displayed to the golf cup within the indentation; and C) modifying the golf cup further such that the golf cup has a circumferential downward facing lip near the top edge of the golf cup, the lip defining the top of the indentation.

9. The method of advertising on a golf course according to claim 8, wherein the lip further functions as a means for removably attaching the flexible insert to the golf cup.

10. The method of advertising on a golf course according to claim 9, further comprising the step of further modifying the golf cup such that the golf cup has a circumferential annular shoulder near the bottom surface of the golf cup, the shoulder defining the bottom of the indentation and functioning as a support for the flexible insert.

11. The method of advertising on a golf course according to claim 8, further comprising the step of further modifying the golf cup such that the golf cup has an opening for accommodating the tip of a tapered tool to facilitate removal of the flexible insert from the golf cup.

12. The method of advertising on a golf course according to claim 10 wherein the length of the flexible insert is no longer than the circumference of the golf cup and the height of the flexible insert corresponds to a distance between the downward facing lip and the annular shoulder.

13. The method of advertising on a golf course according to claim 9 wherein the length of the flexible insert is no longer than the circumference of the inner wall and the height of the flexible insert corresponds to a distance between the downward facing lip and the bottom surface of the golf cup.

14. The method of advertising on a golf course according to claim 12 wherein the flexible insert measures approximately 3" in height and 13¼" in length.

15. A golf cup modified for advertising comprising:

a) a golf cup having a top edge and a bottom surface spanned by a circularly cylindrical inner wall, the inner wall having a circumference and an indentation and the bottom surface of the golf cup having drain holes, the indentation having a top and a bottom;

b) at least one flat flexible insert having a length and a height, on which advertising material is printed, which when flexed can be removably connected to the golf cup such that the insert is flush with the inner wall and entirely within the indentation;

c) a downwardly angled lip around the circumference of the inner wall near the top edge of the golf cup, the lip defining the top of the indentation and further functioning as a means for removably connecting the flexible insert to the golf cup; and d) an annular shoulder around the circumference of the inner wall near the bottom surface of the golf cup, the shoulder defining the bottom of the indentation and functioning as a support for the flexible insert;

e) the inner wall further having an opening for accommodating the tip of a tapered tool to facilitate removal of the flexible insert from the golf cup.

16. The modified golf cup according to claim 15 wherein the length of the flexible insert is no longer than the circumference of the inner wall and the height of the flexible insert corresponds to a distance between the downward facing lip and the annular shoulder.

17. The modified golf cup according to claim 16 wherein the flexible insert measures approximately 3" in height and 13¼" in length.

* * * * *